US010767872B2

(12) United States Patent
Avila et al.

(10) Patent No.: US 10,767,872 B2
(45) Date of Patent: Sep. 8, 2020

(54) BUILT-IN OVEN WITH HEIGHT ADJUSTER

(71) Applicant: WHIRLPOOL CORPORATION, Benton Harbor, MI (US)

(72) Inventors: Leonel Avila, Joinville (BR); Fabio Bianchi, Cassinetta di Biandronno (IT); Rodrigo Wojcik Nunes Pereira, Joinville (BR); Ramiro Ruthes Junior, Joinville (BR); Cleberson Jean Sousa, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 324 days.

(21) Appl. No.: 15/727,077

(22) Filed: Oct. 6, 2017

(65) Prior Publication Data

US 2018/0031249 A1 Feb. 1, 2018

Related U.S. Application Data

(63) Continuation of application No. 13/090,544, filed on Apr. 20, 2011, now Pat. No. 9,857,083.

(51) Int. Cl.

| | |
|---|---|
| ***F24C 15/08*** | (2006.01) |
| *F24C 3/02* | (2006.01) |
| *F24C 3/08* | (2006.01) |

(52) U.S. Cl.

CPC ..... *F24C 15/086* (2013.01); *F24C 3/027* (2013.01); *F24C 3/087* (2013.01)

(58) Field of Classification Search

CPC ..... F24C 15/086; F24C 3/027; F24C 3/087

USPC ..... 126/237 R; 248/188.5

See application file for complete search history.

(56) References Cited

U.S. PATENT DOCUMENTS

| | | | |
|---|---|---|---|
| 133,766 | A | 12/1872 | Easterly |
| 464,921 | A | 12/1891 | Carr |
| 1,006,974 | A | 10/1911 | Moore et al. |
| 1,655,611 | A | 1/1928 | Jenson |
| 2,544,822 | A | 3/1951 | Brown |
| 2,793,467 | A | 5/1957 | Matter |
| 2,877,875 | A | 3/1959 | Bolt |
| 3,071,887 | A | 1/1963 | Von Arb |
| 3,186,670 | A | 6/1965 | Perl |
| 3,239,218 | A | 3/1966 | Reeves |
| 3,304,032 | A | 2/1967 | Yates |
| 3,692,266 | A | 9/1972 | Jacobs |
| 3,750,989 | A | 8/1973 | Bergeson |
| 3,927,853 | A | 12/1975 | Guth |

(Continued)

FOREIGN PATENT DOCUMENTS

| | | | |
|---|---|---|---|
| GB | 2242620 | A | 9/1991 |
| GB | 2323276 | A | 9/1998 |

(Continued)

*Primary Examiner* — Edelmira Bosques
*Assistant Examiner* — Dana K Tighe
(74) *Attorney, Agent, or Firm* — Price Heneveld LLP

(57) ABSTRACT

A domestic appliance including a built-in oven configured to be positioned in a cut-out defined in a kitchen. The built-in oven includes a housing having a cooking chamber defined therein, a lower frame positioned below the cooking chamber, and a height adjuster coupled the lower frame. The built-in oven has a first vertical height when the height adjuster is positioned in a first predetermined position and a second vertical height when the height adjuster is positioned in a second predetermined position.

16 Claims, 8 Drawing Sheets

(56) References Cited

U.S. PATENT DOCUMENTS

| | | | | |
|---|---|---|---|---|
| 4,518,142 | A | 5/1985 | Sulcek et al. | |
| 4,753,406 | A | 6/1988 | Kodama et al. | |
| 4,763,638 | A | 8/1988 | Hurley et al. | |
| 4,867,504 | A | 9/1989 | Johnson, Jr. | |
| 5,107,775 | A * | 4/1992 | Langlais ..... | A47B 91/02 108/147.21 |
| 5,224,227 | A | 7/1993 | Mcginley | |
| 5,333,825 | A | 8/1994 | Christensen | |
| 5,471,709 | A | 12/1995 | Lanzani | |
| 5,493,947 | A | 2/1996 | Philbeck | |
| 5,749,550 | A | 5/1998 | Jackson | |
| 5,967,472 | A | 10/1999 | Wilhelmstatter et al. | |
| 5,967,634 | A | 10/1999 | Baca | |
| 6,575,414 | B2 | 6/2003 | Cuzzocrea | |
| 6,796,113 | B2 | 9/2004 | Moore | |
| D550,069 | S | 9/2007 | Mulligan | |
| 8,220,760 | B2 | 7/2012 | Fetzer et al. | |
| 9,119,469 | B2 | 9/2015 | Seefeldt et al. | |
| 2006/0022180 | A1 | 2/2006 | Selness | |
| 2008/0251660 | A1 | 10/2008 | Spyker | |
| 2010/0176256 | A1 | 7/2010 | Bove | |
| 2010/0276564 | A1 | 11/2010 | Fetzer et al. | |
| 2012/0248264 | A1 | 10/2012 | Arslankiray et al. | |
| 2012/0266435 | A1 | 10/2012 | Avila et al. | |

FOREIGN PATENT DOCUMENTS

| | | | |
|---|---|---|---|
| JP | 6058555 | A | 3/1994 |
| SU | 1530168 | A1 | 12/1989 |

* cited by examiner

BUILT-IN OVEN WITH HEIGHT ADJUSTER

CROSS-REFERENCE TO RELATED APPLICATIONS

This application is a continuation of U.S. patent application Ser. No. 13/090,544 (now U.S. Pat. No. 9,857,083), entitled BUILT-IN OVEN WITH HEIGHT ADJUSTER, filed on Apr. 20, 2011, which is a application of U.S. patent application Ser. No. 13/090,491, now U.S. Pat. No. 8,813, 328, entitled METHOD & APPARATUS FOR INSTALLING A BUILT-IN OVEN INTO A CABINET CUT-OUT, which was also filed on Apr. 20, 2011.

TECHNICAL FIELD

The present disclosure relates generally to a domestic oven and more particularly to domestic built-in ovens.

BACKGROUND

A domestic built-in oven is used to cook meals and other foodstuffs and may include a single cooking chamber or multiple cooking chambers. Built-in ovens may be installed in a cut-out opening formed in a cabinet or wall of a home kitchen. The opening formed in the cabinet or wall is typically custom-sized to match the dimensions of the built-in oven purchased at the time the kitchen was built or last remodeled.

SUMMARY

According to one aspect of the disclosure, a method of installing a replacement built-in oven into a cut-out defined in a kitchen is disclosed. The method includes identifying a used built-in oven positioned in the cut-out of the kitchen, positioning a height adjuster of the replacement built-in oven into one of a number of predetermined positions based on the identity of the used built-in oven, and installing the replacement built-in oven in the cut-out of the kitchen. In some embodiments, the method may also include selecting a pre-sized bottom trim piece based on the position of the height adjuster, and attaching the pre-sized bottom trim piece at the front of the cut-out after the replacement built-in oven is installed in the cut-out.

In some embodiments, positioning the height adjuster may include selecting the position of the height adjuster from a look-up table comprising a plurality of predetermined positions, each of which corresponds to the identity of the used built-in oven. Additionally, in some embodiments, positioning the height adjuster may include adjusting each of a plurality of mounting legs extending from a lower frame of the replacement built-in oven. In some embodiments, adjusting each of the plurality of mounting legs may include increasing a vertical height of each of the mounting legs from a first predetermined vertical height to a second predetermined vertical height.

In some embodiments, adjusting each of the plurality of mounting legs may include moving each of the mounting legs from a first orientation relative to the lower frame to a second orientation relative to the lower frame. In some embodiments, moving each of the mounting legs may include decoupling each of the mounting legs from the lower frame of the replacement built-in oven and reattaching each of the mounting legs in the second orientation relative to the lower frame. Additionally, in some embodiments, positioning the height adjuster may include attaching a plurality of mounting legs to a lower frame of the replacement built-in oven.

In some embodiments, positioning the height adjuster ay include rotating a link coupled to the height adjuster to move the height adjuster from a first predetermined position to a second predetermined position relative to a lower frame of the replacement built-in oven.

According to another aspect, the method includes identifying a used built-in oven associated with the cut-out, determining a fit adjustment based on the identity of the used built-in oven associated with the cut-out, positioning a height adjuster of the replacement built-in oven based on the fit adjustment, and installing the replacement built-in oven into the cut-out of the cabinet. In some embodiments, determining the fit adjustment may include selecting from a look-up table the fit adjustment corresponding to the identity of the used built-in oven associated with the cut-out.

In some embodiments, positioning the height adjuster may include attaching at least one mounting leg to a lower frame of the replacement built-in oven. In some embodiments, positioning the height adjuster may include changing an orientation of a mounting leg relative to a lower frame of the replacement built-in oven. Additionally, in some embodiments, positioning the height adjuster may include operating an adjustment rod of the height adjuster to move the height adjuster from a first predetermined position to a second predetermined position relative to a lower frame of the replacement built-in oven.

In some embodiments, the method may selecting a pre-sized trim piece based on the determined fit adjustment, and attaching the pre-sized trim piece to the front of the cabinet when the replacement built-in oven is installed in the cabinet.

According to another aspect, a domestic appliance is disclosed. The domestic appliance includes a built-in oven to be positioned in a cut-out defined in a front of a cabinet. The built-in oven includes a housing having a cooking chamber defined therein and a lower frame positioned below the cooking chamber, and a height adjuster coupled the lower frame. The height adjuster has a number of predetermined positions. The built-in oven has a first vertical height when the height adjuster is positioned in a first predetermined position, and a second vertical height when the height adjuster is positioned in a second predetermined position. The second vertical height is greater than the first vertical height.

In some embodiments, the height adjuster may include a mounting leg having a first length defined along a first side and a second length defined along a second side. In some embodiments, the housing and the first length of the mounting leg may define the first vertical height of the built-in oven when the height adjuster is positioned in the first predetermined position. Additionally, the housing and the second length of the mounting leg may define the second vertical height of the built-in oven when the height adjuster is positioned in the second predetermined position.

In some embodiments, the second side of the mounting leg may be in contact with the lower frame when the height adjuster is positioned in the first predetermined position, and the first side of the mounting leg may be in contact with the lower frame when the height adjuster is positioned in the second predetermined position. In some embodiments, the mounting leg may be removably coupled to the lower frame of the housing. Additionally, in some embodiments, the adjuster may include four mounting legs. Each of the mounting legs may be secured to a corner of the lower frame.

In some embodiments, the height adjuster may include a first wedge positioned below the lower frame. The first wedge may have a first inclined surface. The adjuster may also include a second wedge secured to the lower frame. The second wedge may have a second inclined surface contacting the first inclined surface. The second wedge may move upwardly along the first inclined surface as the height adjuster is moved from the first predetermined position to the second predetermined position.

In some embodiments, the height adjuster may further include a base secured to the first wedge, and a threaded shaft rotatively coupled to the base and the second wedge such that rotation of the threaded shaft causes the second wedge to move upwardly along the first inclined surface. Additionally, in some embodiments, the height adjuster may further include a third wedge coupled to the base behind the first wedge. The third wedge may have a third inclined surface. The adjuster may also include a fourth wedge secured to the lower frame. The fourth wedge may have a fourth inclined surface contacting the third inclined surface. The fourth wedge may move upwardly along the third inclined surface as the height adjuster is moved from the first predetermined position to the second predetermined position.

In some embodiments, the height adjuster may include a base positioned below the lower frame, a link rotatably coupled to the base at a first end and rotatably coupled to the lower frame at a second end opposite the first end, and a stop extending from the link. The stop may contact the base when the height adjuster is positioned in the second predetermined position. In some embodiments, the domestic appliance may further include a locking device configured to prevent the link from rotating relative to the lower frame.

In some embodiments, the domestic appliance may further include a plurality of pre-sized bottom trim pieces configured to be secured to the housing. In some embodiments, a first pre-sized bottom trim piece of the plurality of pre-sized bottom trim pieces may be secured to the housing when the height adjuster is placed in the first predetermined position, the first pre-sized bottom trim piece. A second pre-sized bottom trim piece of the plurality of pre-sized bottom trim pieces may be secured to the housing when the height adjuster is placed in the second predetermined position. The second pre-sized bottom trim piece may have a greater vertical height than the first pre-sized bottom trim piece.

According to another aspect, the domestic appliance includes a built-in oven to be positioned in a cut-out defined a kitchen. The built-in oven includes a housing having a first cooking chamber defined therein and a lower frame positioned below the first cooking chamber. The built-in oven also includes a mounting leg removably coupled to the lower frame. The mounting leg has a first length defined along a first side and a second length defined along a second side. The second length is greater than the first length. The housing of the built-in oven and the first length of the mounting leg define a first vertical height when the second side of the mounting leg is in contact with the lower frame, and the housing and the second length of the mounting leg define a second vertical height when the first side of the mounting leg is in contact with the lower frame.

In some embodiments, the domestic appliance may further include a plurality of pre-sized bottom trim pieces configured to be positioned at the front of the cut-out to close the gap between the built-in oven and the cut-out. In some embodiments, the built-in oven may include a second cooking chamber positioned between the first cooking chamber and the lower frame.

BRIEF DESCRIPTION OF THE DRAWINGS

The detailed description particularly refers to the following figures, in which.

DETAILED DESCRIPTION OF THE DRAWINGS

Figure 1:
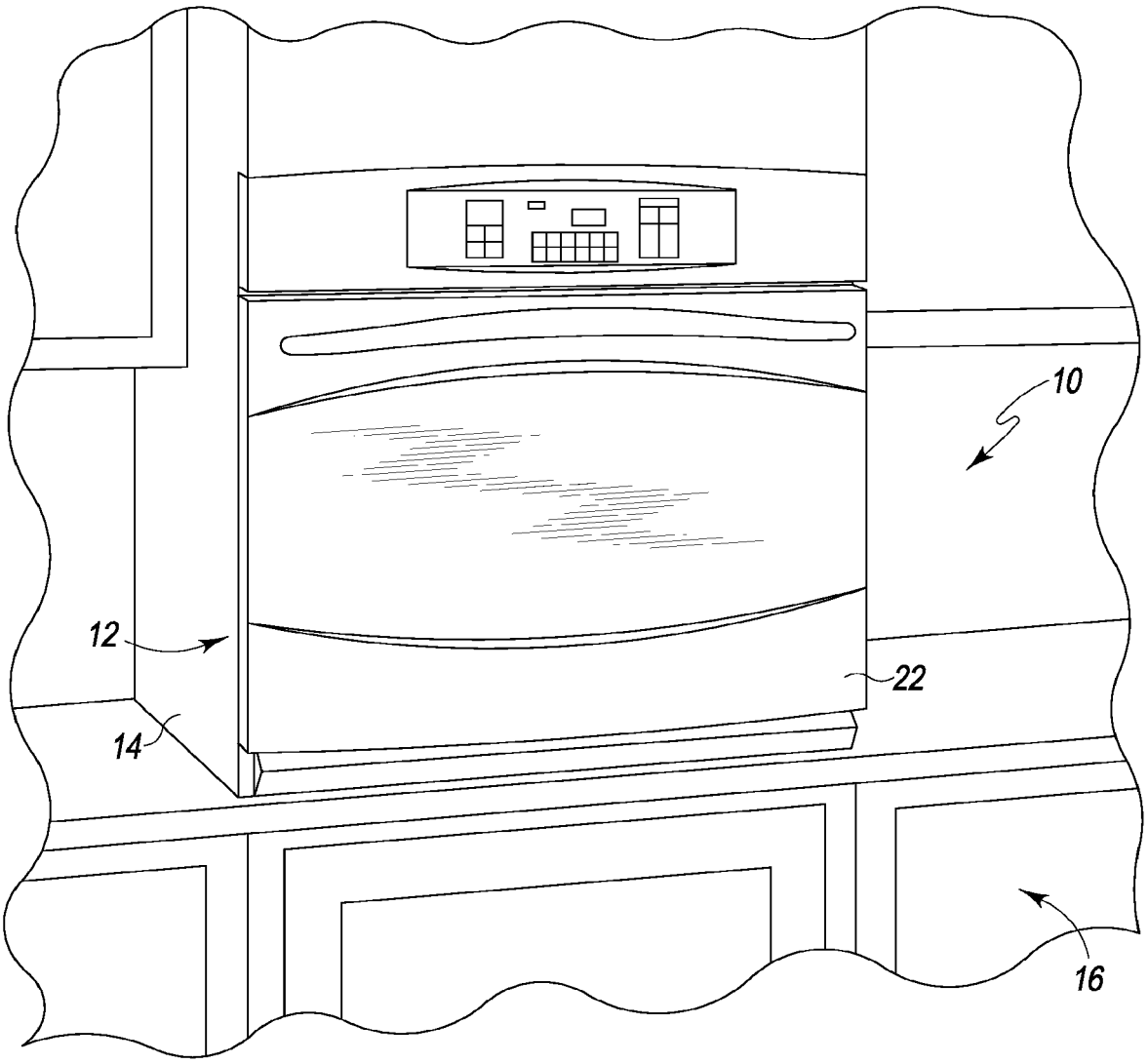
FIG. 1 is a perspective view a used built-in oven positioned in a kitchen cabinet.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a domestic oven appliance is shown as a built-in oven 10. The term "built-in oven" is defined herein as a domestic cooking appliance including a cooking chamber configured to cook foodstuffs, which is configured to be installed in a cut-out or cavity defined in a kitchen. As such, a built-in oven is distinguishable from, and in contrast to, a domestic range that is equipped with surface heating elements or burners and at least one cooking chamber. A built-in oven is also distinguishable from a domestic appliance that is configured to be moveable.

Figure 2:
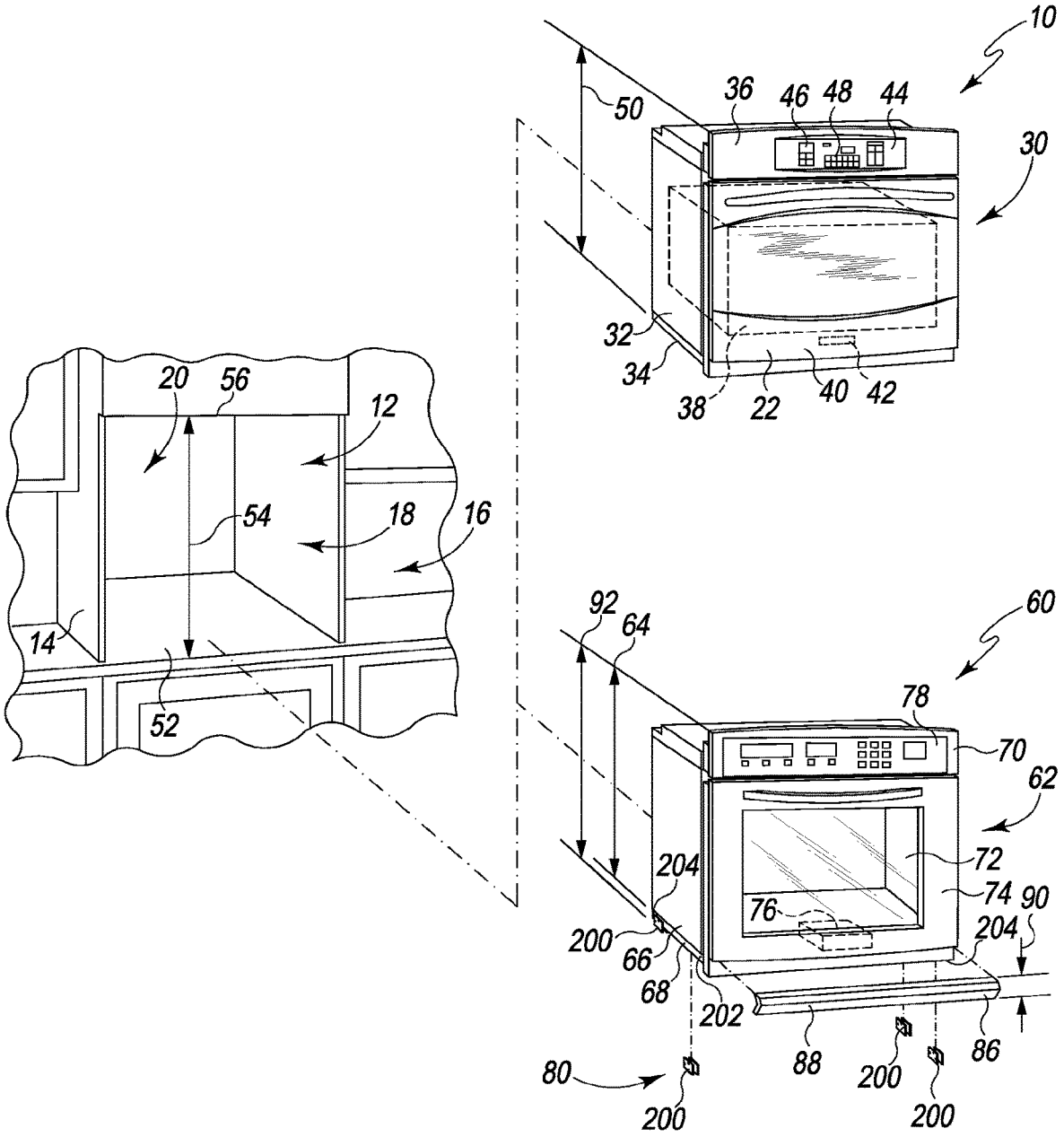
FIG. 2 is a perspective view of the opening formed in the kitchen cabinet of FIG. 1, a replacement built-in oven to be installed in the opening and one embodiment of a height adjuster.

The built-in oven 10 is shown positioned in a cut-out 12 formed in a cabinet 14 of a home kitchen 16. It will be appreciated that in other embodiments the cut-out 12 may be formed in other areas of the kitchen 16, such as, for example, a kitchen wall. As shown in FIG. 2, the cut-out 12 defines an oven compartment 18 and includes an opening 20 formed in the front surface of the cabinet 14. When installed in the cut-out 12, the front 22 of the built-oven 10 is accessible by the user.

The built-in oven 10 includes a housing 30 extending from a lower frame 34 to an upper panel 36. The housing 30 has a cooking chamber 38 defined therein into which pans, sheets, or other cookware carrying food may be placed to be heated. A number of racks (not shown) are positioned in the cooking chamber 38, and the racks and the cooking chamber 38 are accessible from the front 22. A door assembly 40 is hinged to the front of the housing 32 and permits access to the cooking chamber 38. An electric baking element 42 is positioned below the cooking chamber 38 and is configured to generate heat for baking or otherwise cooking food items in the cooking chamber 38. It will be appreciated that in other embodiments the baking element may be a gas-fired baking element that uses natural gas as a combustion source to generate heat. While the built-in oven 10 shown in FIG. 1 has only a single cooking chamber 38, it will be appreciated that in other embodiments the built-in oven may be a dual or combination built-in oven having more than one cooking chamber.

A user may control the operation of the baking element 42 using an interface 44 located on the upper panel 36. The interface 44 includes a display 46 and a set of push buttons 48 that are connected to an automated control system (not shown) operable to control the operation of the baking element 42. For example, the user may use the interface 44 to set a desired temperature for the cooking chamber 38. The automated control system responds by supplying electrical power to the baking element 42 and adjusting amount of power supplied as necessary to heat the cooking chamber 38 to the desired temperature.

Each built-in oven 10 may have a different overall footprint and may vary from other built-in ovens in, for example, height or depth. Typically, the cut-out 12 is sized based on the identity (i.e., the brand or model) of the first or original built-in oven to be installed in the kitchen 16. For example, when a home owner purchases a built-in oven 10 produced by one manufacturer, the kitchen designer or cabinet maker will typically size the cut-out 12 to fit the footprint of that built-in oven. Among other things, a vertical dimension 54 of the cut-out 12 is custom-sized to the first built-in oven 10.

As shown in FIGS. 1-2, the built-in oven 10 has a height 50. When the built-in oven 10 is installed in the cut-out 12, the lower frame 34 contacts the bottom surface 52 of the cut-out 12. Because the vertical dimension 54 of the cut-out 12 is sized to fit the height 50 of the built-in oven 10, the upper panel 36 of the built-in oven 10 is in contact with the upper section 56 of the cut-out 12 when the built-in oven 10 is installed in the cut-out 12. Additionally, the opening 20 of the cut-out 12 is filled by the built-in oven 10.

As shown in FIG. 2, the original, used built-in oven 10 may be removed from the cut-out 12 and replaced by a replacement built-in oven 60. The term "replacement built-in oven" is defined herein as a built-in oven that is a different brand or model of built-in oven from the used built-in oven. For example, if the used built-in oven was produced by Manufacturer A, the replacement built-in oven might have been produced by Manufacturer B. Similarly, the used built-in oven and the replacement built-in oven might be different models produced by the same manufacturer. In any event, the cut-out 12 does not match the footprint (e.g., height or depth) of the replacement built-in oven because the replacement built-in oven is a different brand or model from the used built-in oven.

Like the used built-in oven 10, the replacement built-in oven 60 includes a housing 62 that extends from a lower frame 68 to an upper panel 70. The housing 62 has a cooking chamber 72 defined therein into which pans, sheets, or other cookware carrying food may be placed to be heated. A door assembly 74 is hinged to the front of the housing 62 and permits access to the cooking chamber 72. An electric baking element 76 is positioned below the cooking chamber 72, and a user may control the operation of the baking element 76 using an interface 78 located on the upper panel 70.

In the illustrative embodiment, the replacement built-in oven 60 has a height 64 that is less than the height 50 of the used built-in oven 10. Because the replacement built-in oven 60 is smaller than the used built-in oven 10, the vertical dimension 54 of the cut-out 12 is not sized to fit the height 64 of the replacement built-in oven 60. Among other things, the replacement built-in oven 60 does not fill the opening 20 of the cut-out 12.

As shown in FIG. 2, the replacement built-in oven 60 includes an adjustment mechanism or height adjuster 80 configured to be secured to the lower frame 68. As will be discussed in greater detail below, the adjuster 80 is operable to lift or raise the lower frame 68 of the replacement built-in oven 60 from the bottom surface 52 of the cut-out 12. In that way, the adjuster 80 is operable to change the position of the replacement built-in oven 60 when the oven is installed in the cut-out 12. The adjuster 80 includes a number of predetermined lift positions that raise or lift replacement built-in oven 60 by various predefined amounts. The adjuster 80 adds to the height 64 of the housing 62 to increase the overall height of the replacement built-in oven 60 to a height 92. It will be appreciated that the height 92 of the replacement built-in oven 60 changes depending on the predetermined position of the adjuster 80.

By lifting the replacement built-in oven 60, a gap is created between the bottom surface 52 of the cut-out 12 and the lower frame 68 of the replacement built-in oven 60. As shown in FIG. 2, the replacement built-in oven 60 includes a pre-sized bottom trim piece 86, which is one of a number of pre-sized bottom trim pieces. The bottom trim piece 86 is attached at the front of the replacement built-in oven 60 when the oven is installed in the cut-out 12. The bottom trim piece 86 has an outer surface 88 that has a predetermined height 90 to cover the gap when the replacement built-in oven 60 is installed in the cut-out 12, as will be discussed in greater detail below.

Figure 3:
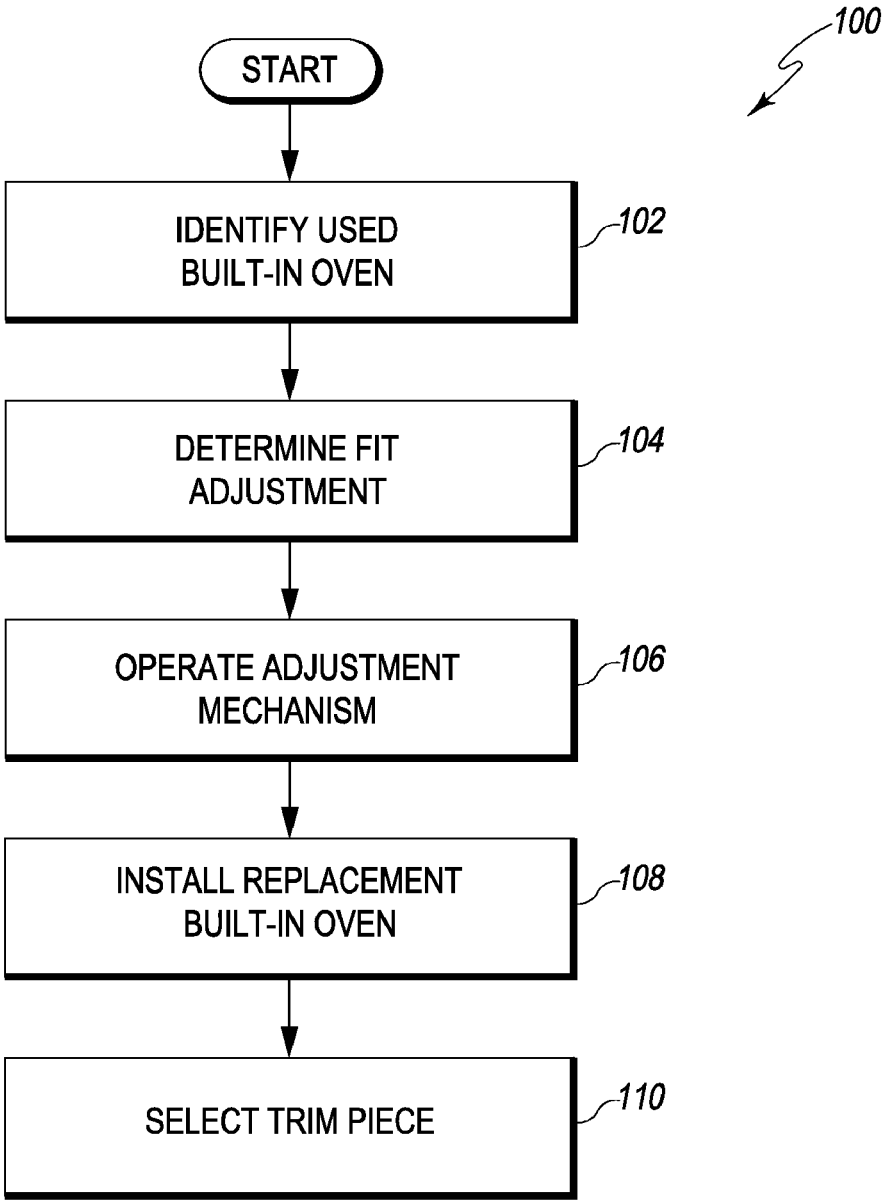
FIG. 3 is a method of installing the replacement oven of FIG. 2.

An exemplary process 100 of installing the replacement built-in oven 60 in the cut-out 12 is shown in FIG. 3. After purchasing the replacement built-in oven 60, the used built-in oven 10 is identified in step 102. The used built-in oven 10 may be identified by its brand-type, model number, manufacturer, or other form of identifying information, such as, for example, whether the used built-in oven 10 is a dual, combination, or single oven of a particular brand. Once the person installing the replacement built-in oven 60 identifies the used built-in oven 10, the installation process may advance to step 104.

In step 104, the user determines the necessary fit adjustment for the replacement built-in oven 60. Because the cut-out 12 is sized based on the identity of the used built-in oven 10, the fit adjustment required to install the replacement built-in oven 60 in the cut-out 12 corresponds to the identity of the used built-in oven 10. As such, the required fit adjustment varies depending on the identity of the used built-in oven 10. For example, because a used built-in oven produced by one manufacturer may be larger than a used built-in oven produced by another manufacturer, the amount of adjustment required to fit the replacement built-in oven 60 in the cut-out 12 may be different for each used built-in oven.

As described above, the adjuster 80 has a number of predetermined positions, each of which lifts the replacement built-in oven 60 by a predetermined amount. The predetermined positions of the adjuster 80 are listed or stored as a function of the identities of various used built-in ovens. For example, the replacement built-in oven 60 may be sold with a product manual that lists the predetermined positions of the adjuster 80 in a look-up table, and each predetermined position may correspond to a different used built-in oven. It will be appreciated, however, that the predetermined positions of the adjuster 80, and, consequently, the identities of the used built-in ovens, may be presented in other formats that permit the user to select the predetermined position corresponding to the identity of the used built-in oven 10. Once the identity of the used built-in oven 10 is known, the person installing the replacement built-in oven 60 may select from the look-up table the predetermined position corresponding to the identity of the used built-in oven 10.

In step 106, the user operates the adjuster 80 to place the adjuster 80 in the predetermined position selected in step 104. As will be described in greater detail below, operating the adjuster 80 may involve repositioning mounting legs on the lower frame 68 of the replacement built-in oven 60, operating a threaded rod, or taking some other action to place the adjuster 80 in the selected predetermined position. Once the adjuster 80 is placed in the selected predetermined position, the replacement built-in oven 60 is installed in the cut-out 12 in step 108.

During installation step 108, the adjuster 80 is placed in contact with the bottom surface 52 of the cut-out 12 and the upper panel 70 of the replacement built-in oven 60 is positioned adjacent to, or in contact with, the upper section 56 of the cut-out 12. When installed in the cut-out 12, the front of the replacement built-in oven 60 is accessible and a gap is formed between the lower frame 68 of the replacement built-in oven 60 and the bottom surface 52 of the cut-out 12.

In step 110, a pre-sized bottom trim piece is selected based on the identity of the used built-in oven 10. The selected bottom trim piece is sized to correspond to the amount the replacement built-in oven 60 is lifted relative to the bottom surface 52 of the cut-out 12. In that way, each pre-sized bottom trim piece is configured to be positioned at the front of the cut-out 12 to close the gap between the replacement built-in oven 60 and the cut-out 12. For example, because a used built-in oven produced by one manufacturer may be larger than a used built-in oven produced by another manufacturer, the amount of adjustment required to fit the replacement built-in oven 60 in the cut-out 12 and the size of the gap formed between the lower frame 68 of the replacement built-in oven 60 and the bottom surface 52 of the cut-out 12 may vary. To cover or close gaps of various sizes, the replacement built-in oven 60 may be sold with a plurality of pre-sized bottom trim pieces having different sizes to cover those different sized gaps.

Like the predetermined positions of the adjuster 80, the different pre-sized bottom trim pieces may be listed as a function of the identities of the used built-in ovens. The variety of trim pieces may be presented in the same format as the predetermined positions of the adjuster 80, such as, for example, in look-up tables, lists, or any other format that relates each pre-sized bottom trim piece to the identity of a particular used built-in oven 10 or a predetermined position of the adjuster 80. Once the pre-sized bottom trim piece is selected, it may be attached at the front of the replacement built-in oven 60 in the cut-out 12.

As shown in FIG. 2, the adjuster 80 includes a plurality of mounting legs 200 configured to be secured to the lower frame 68. Each mounting leg 200 is attached to a rail 202 of the frame 68 at each corner 204 of the replacement built-in oven 60. It will be appreciated that in other embodiments the adjuster 80 may include additional or fewer mounting legs 200. Additionally, in other embodiments, each mounting leg 200 may be attached to the lower frame 68 in locations different from those shown.

Figure 4:
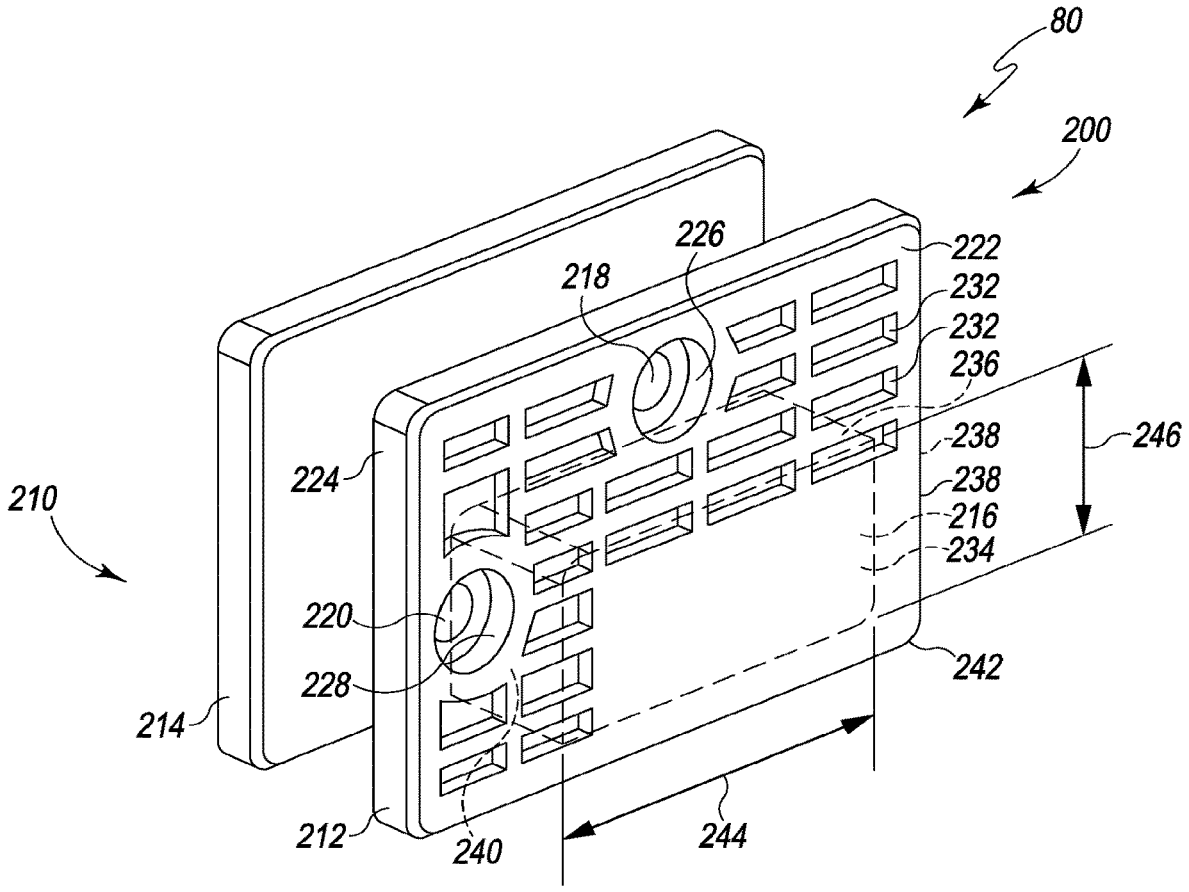
FIG. 4 is a perspective view of one mounting leg of the height adjuster shown in FIG. 2.
Figure 5A:
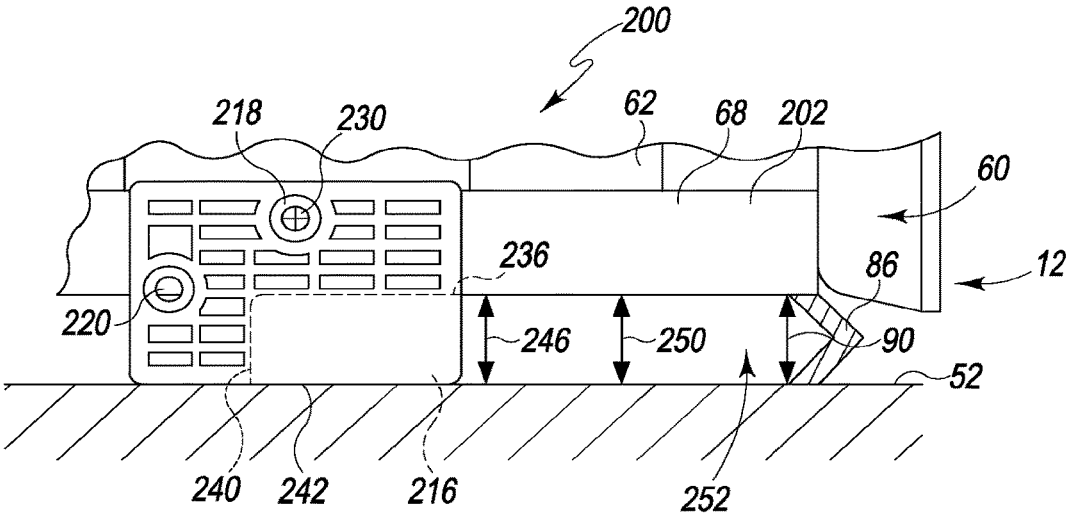
FIG. 5A is a side elevation view showing the mounting leg of FIG. 4 attached to a replacement built-in oven in a predetermined position.
Figure 5B:
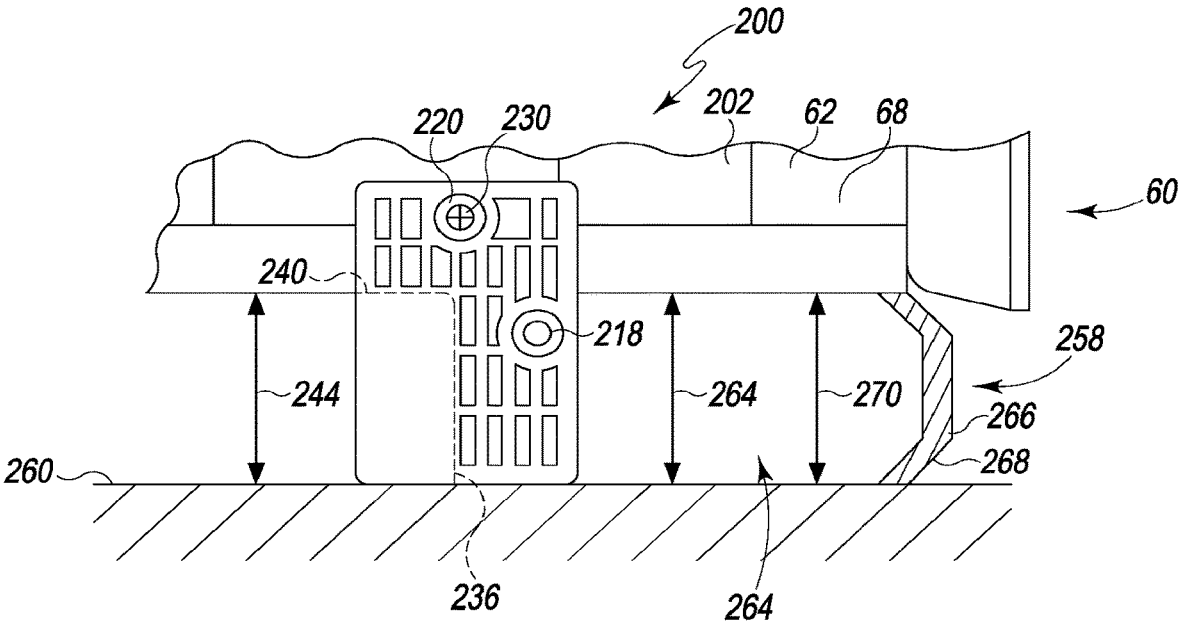
FIG. 5B is a side elevation view showing the mounting leg of FIGS. 4 and 5A attached to the replacement built-in oven in another predetermined position.

Referring now to FIGS. 4 and 5A-B, one of the mounting legs 200 is shown greater detail. The mounting leg 200 has a shell 210 including a pair of sidewalls 212, 214 and a lifter block 216 connecting the sidewall 212 to the sidewall 214. The sidewall 212 includes a pair of through-holes 218, 220 extending from an outer surface 222 to an inner surface 224. The through-holes 218, 220 include countersinks 226, 228 formed in the outer surface 222. A fastener 230 (see FIGS. 5A-B) is received in one of the through-holes 218, 220 when the mounting leg 200 is secured to the lower frame 68.

The sidewall 212 also includes a plurality of rectangular apertures 232 defined in the outer surface 222. As shown in FIG. 4, the apertures 232 do not extend through the sidewall 212 to the inner surface 224. It will be appreciated that in other embodiments some or all of the apertures 232 may extend from the outer surface 222 to the inner surface 224. Additionally, in some embodiments, the number of apertures 232 may be increased or reduced or the apertures 232 may be eliminated from the sidewall 212.

The lifter block 216 has a body 234 that includes a long side 236 extending from an end 238 of the shell 210. The body 234 also includes a short side 240 extending from another end 242 of the shell 210 to intersect with the side 236. The side 236 has a length 244, and the side 240 has a length 246 that is shorter than the length 244.

As shown in FIGS. 5A and 5B, the rail 202 of the lower frame 68 is received between the sidewalls 212, 214 when the mounting leg 200 is secured to the replacement built-in oven 60. Referring now to FIG. 5A, the mounting leg 200 is shown extending downwardly from the lower frame 68 in one predetermined position. In that predetermined position, the side 236 is in contact with the lower frame 68, and the fastener 230 extends through the through-hole 218 into the rail 202. In the illustrative embodiment, the fastener 230 is a screw, but it will be appreciated that in other embodiments the fastener may take also take the form of a pin, key, shaft, or rod configured to secure the mounting leg 200 to the lower frame 68.

As shown in FIG. 5A, the end 242 of the mounting leg 200 is in contact with the bottom surface 52 of the cut-out 12 when the replacement built-in oven 60 is installed therein. The length 246 of the lifter block 216 adds to the height 64 of the housing 62, thereby increasing the overall height of the replacement built-in oven 60 to the height 92.

The length 246 of the short side 240 also defines the length 250 of gap 252 formed between the lower frame 68 and the bottom surface 52. The bottom trim piece 86 is positioned at the front of the cut-out 12 and is attached to the lower frame 68 of the replacement built-in oven 60. The predetermined height 90 of the bottom trim piece 86 also corresponds to the length 246 of the short side 240 of the lifter block 216. As shown in FIG. 5A, the bottom trim piece 86 fills the gap 252.

Referring now to FIG. 5B, the replacement built-in oven 60 is shown installed in another cut-out 258 larger than the cut-out 12, requiring the adjuster 80 to be placed in another predetermined position. If the mounting leg 200 is already secured to the lower frame 68 in the predetermined position shown in FIG. 5A, the user must decouple the mounting leg 200 from the lower frame 68 and rotate the mounting leg 200 to the position shown in FIG. 5B.

In FIG. 5B, the mounting leg 200 is secured to the replacement built-in oven 60 in the second predetermined position and extends downwardly from the lower frame 68. In that predetermined position, the side 240 of the lifter block 216 is in contact with the lower frame 68, and the fastener 230 extends through the through-hole 220 into the rail 202. The end 238 of the mounting leg 200 is in contact with the bottom surface 260 of the cut-out 258. The length 244 of the long side 236 of the lifter block 216 adds to the height 64 of the housing 62, thereby increasing the overall height of the replacement built-in oven 60. The length 244 also increases the gap 262 formed between the lower frame 68 and the bottom surface 260 to a length 264.

Another pre-sized bottom trim piece 266 is positioned at the front of the cut-out 258 and attached to the lower frame 68 of the replacement built-in oven 60. The bottom trim piece 266 has an outer surface 268 that has a predetermined height 270 to cover the length 264 of the gap 262. As shown in FIG. 5B, the predetermined height 270 of the bottom trim piece 266 corresponds to the length 244 of the long side 236 of the lifter block 216. The predetermined height 270 of the bottom trim piece 266 is also greater than the predetermined height 90 of the pre-sized bottom trim piece 86.

As shown in FIGS. 4 and 5A-B, the mounting leg 200 has only two predetermined positions. It will be appreciated that in other embodiments the mounting leg may include additional predetermined positions to increase the number of adjustments that can be made to the replacement built-in oven 60. Additionally, in some embodiments, the mounting leg 200 may be non-removably secured to the lower frame 68. It will also be appreciated that in other embodiments the adjuster 80 and the pre-sized bottom trim pieces 86, 266 may be sold as accessories separate from the replacement built-in oven 60.

Figure 6:
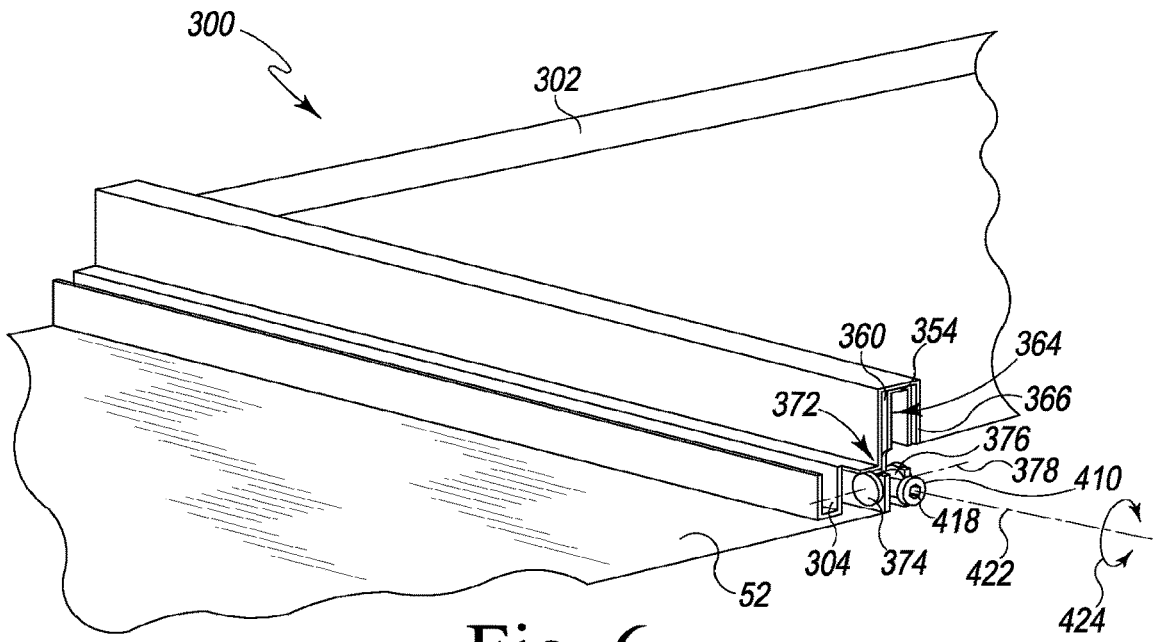
FIG. 6 is a perspective view of another embodiment of the height adjuster in one predetermined position.
Figure 7:
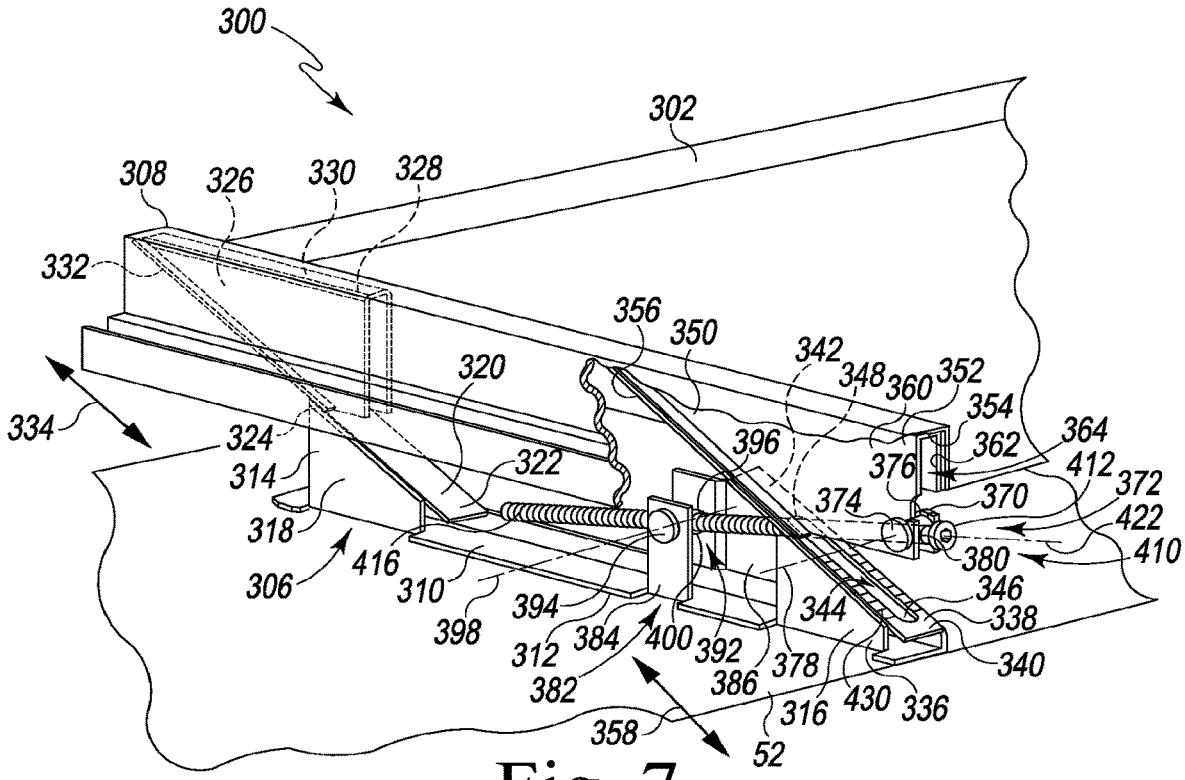
FIG. 7 is a diagrammatic perspective view of the height adjuster of FIG. 6 in another predetermined position.

Referring now to FIGS. 6 and 7, another embodiment of a height adjuster (hereinafter adjuster 300) is shown. The adjuster 300 includes a support frame 302 configured to be secured to the lower frame 68 of the replacement built-in oven 60. As shown in FIG. 6, the support frame 302 includes a channel 304 sized to receive the rail 202 of the lower frame 68. Another channel (not shown) receives the rail formed on the opposite side of the lower frame 68. It will be appreciated that in other embodiments the support frame 302 may replace the lower frame 68 to non-removably secure the adjuster 300 to the housing 66 of the replacement built-in oven 60.

As best seen in FIG. 7, the adjuster 300 also includes a base 306 positioned below the support frame 302 on one side 308 thereof. A second base (not shown) is positioned below the support frame 302 on the opposite side. The base 306 includes a lower frame 310 with a bottom surface 312 configured to contact the bottom surface 52 of the cut-out 12. The base 306 also includes a rear wedge 314 and a forward wedge 316 extending upwardly from the lower frame 310. The rear wedge 314 includes a triangular-shaped body 318 having an inclined surface 320 extending from a lower end 322 to an upper end 324.

The adjuster 300 also includes a sliding wedge 326 that is positioned between the rear wedge 314 and the support frame 302. The sliding wedge 326 has a shell 328 including an upper surface 330 in contact with the support frame 302. In some embodiments, the sliding wedge 326 may be secured to the support frame 302. The shell 328 also includes an inclined surface 332 that is in contact with the inclined surface 320 of the rear wedge 314. As shown in FIGS. 6 and 7, the wedge 326 is configured to slide upwardly and downwardly in the direction indicated by arrow 334 along the inclined surface 320 from the lower end 322 to the upper end 324 of the rear wedge 314.

The forward wedge 316 includes a triangular-shaped body 336 having an inclined surface 338 extending from a lower end 340 to an upper end 342. The inclined surface 338 has a slot 344 defined therein extending from an end 346 positioned adjacent to the lower end 340 of the body 336 to another end 348.

The adjuster 300 also includes another sliding wedge 350 that is positioned between the forward wedge 316 and the support frame 302. The sliding wedge 350 has a shell 352 including an upper surface 354 in contact with the support frame 302. The shell 352 also includes an inclined surface 356 that is in contact with the inclined surface 338 of the forward wedge 316. As shown in FIG. 7, the inclined surfaces 338, 320 of the wedges 314, 316 have approximately the same slope. The sliding wedge 350, like the sliding wedge 326, is configured to slide upwardly and downwardly in the direction indicated by arrow 358 along the inclined surface 338 of the forward wedge 316.

The shell 352 has a pair of sidewalls 360, 362 that define a U-shaped channel 364. The U-shaped channel 364 extends from a front end 366 to the inclined surface 356. The sidewall 360 has an opening (not shown) defined therein and the sidewall 362 has a corresponding slot 370 defined therein opposite the opening 368.

The adjuster 300 includes a mount 372 that is received in the opening 368 and the slot 370 of the sliding wedge 350. The mount 372 has a head 374 and a body 376 extending therefrom. The head 374 is positioned in contact with the sidewall 360, and the body 376 extends through the opening 368 and across the U-shaped channel 364. The body 376 is received in the slot 370 of the sidewall 362. The body 376 of the mount 372 is rotatable within the slot 370 and the opening 368 about an axis 378. An eyelet 380 is defined in the mount 372, extending through the body 376 orthogonally to the axis 378.

The base 306 of the adjuster 300 includes a support 382 positioned between the rear wedge 314 and the forward wedge 316. The support 382 includes a pair of posts 384, 386 extending upwardly from the lower frame 310. The posts 384, 386 include a pair of holes (not shown) extending therethrough.

The adjuster 300 includes another mount 392 that is received in the pair of holes 388, 390. The mount 392 has a head 394 and a body 396 extending therefrom. The head 394 is positioned in contact with the post 384. The body 396 extends through the hole 388, across the space between the posts 384, 386, and is received in the hole 390 of the post 386. The body 396 of the mount 392 is rotatable within the holes 388, 390 about an axis 398. An eyelet 400 is defined in the mount 392, extending through the body 396 orthogonally to the axis 398.

The adjuster 300 also includes an adjustment rod 410 pivotably coupled to the sliding wedge 326 and the base 306. As shown in FIG. 7, the rod 410 includes a head 412 and a body 416 extending therefrom. The head 412 is positioned in contact with the body 376 of the mount 372 and includes a socket 418 configured to receive a tool having a matching cross-section. As shown in FIGS. 6 and 7, the socket 418 has a hex-shaped cross-section. It will be appreciated that in other embodiments socket 418 may have a double hex-shaped, a square-shaped, or other suitable cross-section. It will also be appreciated that in other embodiments the head 412 may be formed with a grip or handle that the user can grasp to turn the rod 410.

The head 412 has an outer diameter greater than the diameter of the eyelet 380 such that the head 412 is prevented from passing through the eyelet 380. The body 416 of the rod 410 extends through the eyelets 380, 400 and the slot 344 to an end 420. The body 416 is externally-threaded and the eyelet 400 has a corresponding internal thread.

To operate the height adjuster 300, the user engages a tool such as, for example, a wrench having a suitable cross-section with socket 418 of the adjustment rod 410. The user may then rotate the rod 410 about axis 422. When the rod 410 is rotated in the direction indicated by arrow 424, the body 416 is advanced through the eyelet 400. As the body 416 is advanced through the eyelet 400, the sliding wedge 350 is advanced upwardly along the inclined surface 338 of the forward wedge 316, and the mounts 372, 392 rotate relative to the axes 378, 398. Additionally, the sliding wedge 326 is advanced upwardly along the inclined surface 320 of the rear wedge 314. As the sliding wedges 326, 350 are advanced upward, the support frame 302 (and, consequently, the lower frame 68 of the replacement built-in oven 60) is lifted or raised relative to the bottom surface 52 of the cut-out 12.

The adjuster 300, like the adapter 80, includes a plurality of different lift positions. As best seen in FIG. 7, the inclined surface 338 of the forward wedge 316 includes indicia 430 that indicate each of predetermined positions of the adjuster 300. As described above, based on the identity of the used built-in oven 10, the person installing the replacement built-in oven 60 may select the predetermined position of the adjuster 300 corresponding to the identity of the used built-in oven 10 and then operate the adjuster 300 to position the adjuster 300 in the selected predetermined position and thereby increase the overall height of the replacement built-in oven 60.

Figure 8:
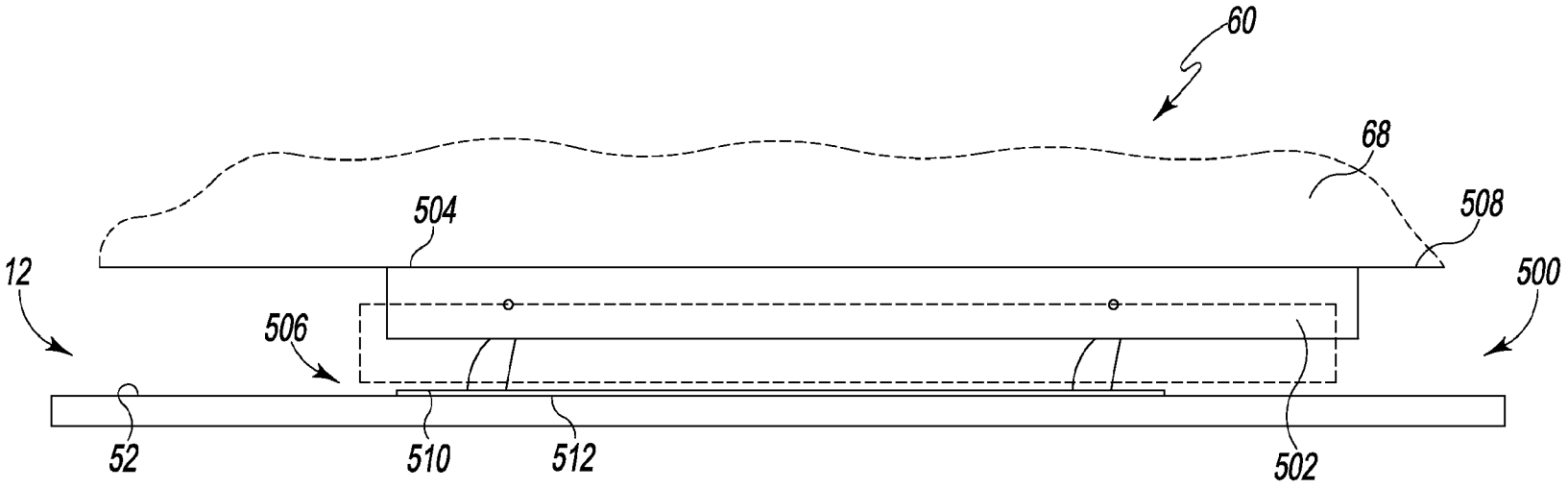
FIG. 8 is a side elevation view of another embodiment of the height adjuster in one predetermined position.
Figure 9:
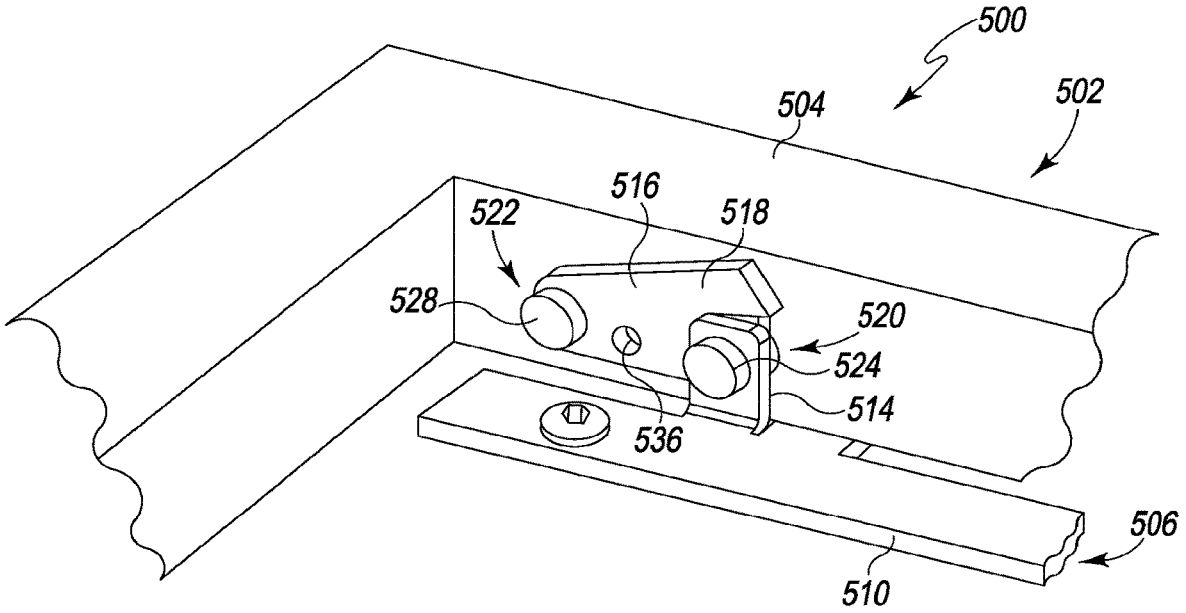
FIG. 9 is a diagrammatic perspective view of the height adjuster of FIG. 8 in another predetermined position.
Figure 10:
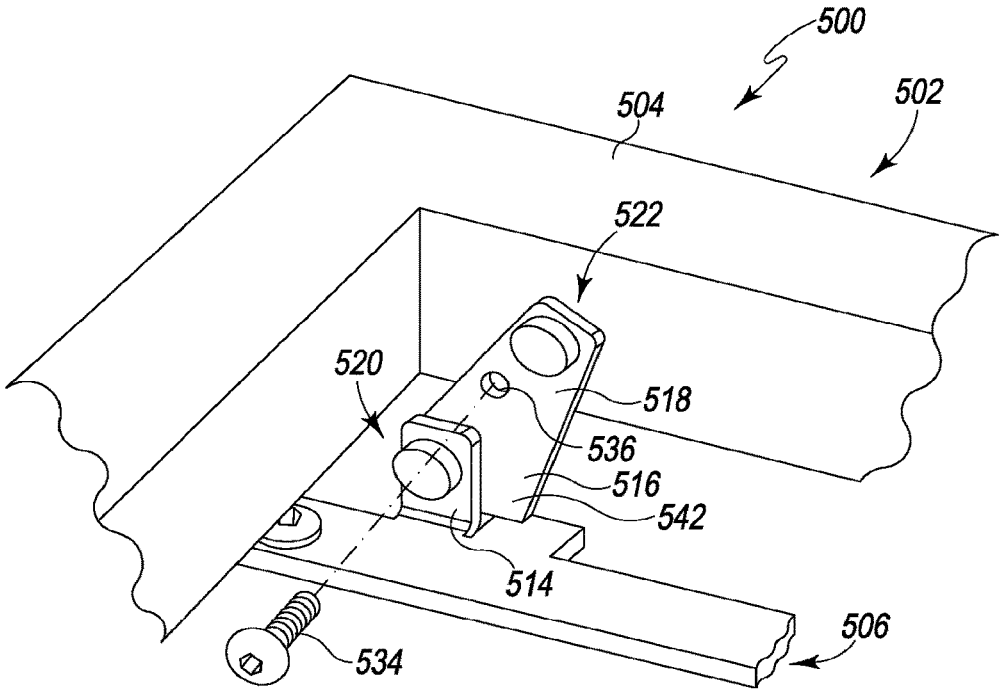
FIG. 10 a diagrammatic perspective view of the height adjuster of FIGS. 8 and 9 in the predetermined position shown in FIG. 8.

Referring now to FIGS. 8-10, another embodiment of a height adjuster (hereinafter adjuster 500) is shown. The adjuster 500 includes a support frame 502 secured to the lower frame 68 of the replacement built-in oven 60. The support frame 502 includes an upper surface 504 that is placed in contact with the lower frame 68 when the adjuster 500 is attached to the replacement built-in oven 60. It will be appreciated that in other embodiments the support frame 502 may replace the lower frame 68 to non-removably secure the adjuster 500 to the housing 66 of the replacement built-in oven 60.

The adjuster 500 also includes a base 506 positioned below the support frame 502 on one side 508 thereof. A second base (not shown) is positioned below the support frame 502 on the opposite side. The base 506 includes a frame 510 with a bottom surface 512 configured to contact the bottom surface 52 of the cut-out 12 when the replacement built-in oven 60 is installed therein.

As best seen in FIGS. 9 and 10, the base 506 also includes a bracket 514 extending upwardly from the frame 510. A rotating link 516 is pivotably coupled to the bracket 514 and the support frame 502. The rotating link 516 has a body 518, which is coupled to the bracket 514 at a pivot joint 520 and is coupled to the support frame 502 at a pivot joint 522. The pivot joint 520 includes a cylindrical pivot pin 524 that extends through, and is received in, a pair of holes (not shown) defined in the bracket 514 and the body 518 of the link 516. The pivot joint 522 similarly includes a cylindrical pivot pin 528 that extends through, and is received in, a pair of holes (not shown) defined in the support frame 502 and the body 518 of the link 516.

As shown in FIGS. 8-10, the adjuster 500 is moveable between a lowered position and a raised position. The lowered position is shown in dashed in FIG. 8 and best seen in FIG. 9. To move from the lowered position, the rotating link 516 is rotated clockwise about pivot joint 520. Simultaneously, the rotating link 516 also pivots about the pivot joint 522 to move to the raised position shown in FIGS. 8 and 10.

The adjuster 500 includes a locking device 532 to lock the adjuster 500 at each position. In the illustrative embodiment, the locking device 532 includes a pin 534 that is received in a hole 536 extending through the body 518 of the rotating link 516 and is received in one of a pair of holes (not shown) defined in the support frame 502. It will be appreciated that in other embodiments the locking device may take the form of a tab, groove, or other structure capable of locking the adjuster 500 at each position.

The body 518 of the rotating link 516 also includes a rotation stop 542. When the adjuster 500 is moved from the lowered position shown in FIG. 9 to the raised position shown in FIG. 10, the stop 542 formed on the body 518 engages with the frame 510 of the base 506 to prevent further movement of the rotating link 516. It will be appreciated that in other embodiments the stop may take the form of a locking pin, tab, or other structure.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. An appliance comprising:

a housing having a lower frame portion;

at least one fixed mounting point positioned on the lower frame portion; and at least one height adjuster releasably coupled to the at least one fixed mounting point of the lower frame portion using a fastener, wherein the height adjuster includes:

first and second sidewalls;

a first fastening point disposed through one of the first and second sidewalls;

a second fastening point disposed through one of the first and second sidewalls, the second fastening point spaced-apart from the first fastening point; and a lifter block interconnecting the first and second sidewalls, wherein the lifter block further includes a first sidewall and a second sidewall;

a first bottom trim piece secured to the housing when the at least one height adjuster is coupled to the at least one fixed mounting point of the lower frame portion at the first fastening point of the at least one height adjuster, wherein the housing is disposed at a first vertical height when the at least one height adjuster is coupled to the at least one fixed mounting point of the lower frame portion at the first fastening point of the at least one height adjuster;

a second bottom trim piece secured to the housing when the at least one height adjuster is coupled to the at least one fixed mounting point of the lower frame portion at the second fastening point of the at least one height adjuster, wherein the second bottom trim piece has a greater vertical height than a vertical height of the first bottom trim piece, and further wherein the housing is disposed at a second vertical height when the at least one height adjuster is coupled to the at least one fixed mounting point of the lower frame portion at the second fastening point of the at least one height adjuster, and further wherein the second vertical height is greater than the first vertical height.

2. The appliance of claim 1, wherein the first and second sidewalls of the lifter block correspond to the first and second vertical heights of the housing.

3. The appliance of claim 2, wherein the at least one height adjuster is configured in a first predetermined position relative to the housing when the at least one height adjuster is coupled to the at least one fixed mounting point of the lower frame portion at the first fastening point of the at least one height adjuster.

4. The appliance of claim 3, wherein the at least one height adjuster is configured in a second predetermined position relative to the housing when the at least one height adjuster is coupled to the at least one fixed mounting point of the lower frame portion at the second fastening point of the at least one height adjuster.

5. The appliance of claim 4, wherein the second sidewall of the lifter block is in contact with the lower frame portion when the at least one height adjuster is in the first predetermined position.

6. The appliance of claim 5, wherein the first sidewall of the lifter block is in contact with the lower frame portion when the at least one height adjuster is in the second predetermined position.

7. The appliance of claim 6, wherein the at least one height adjuster includes four height adjusters.

8. The appliance of claim 7, wherein each of the four height adjusters are secured to a respective corner of the lower frame portion.

9. An appliance comprising:

a housing having a frame;

at least one fixed mounting point configured on the frame;

at least one height adjuster removeably coupled to the at least one fixed mounting point of the frame, wherein the at least one height adjuster is configured to support the housing above a support surface and includes first and second sidewalls that are interconnected by a lifter block, wherein the lifter block includes a first length defined along a first sidewall of the lifter block and a second length defined along a second sidewall of the lifter block, wherein the second length is greater than the first length, and further wherein the first and second sidewalls each include first and second surfaces;

wherein the first length of the lifter block defines a first vertical height for the appliance when the second sidewall of the lifter block is in contact with the frame in a first predetermined position of the height adjuster, and further wherein the second length of the lifter block defines a second vertical height for the appliance when the height adjuster is rotated to a second predetermined position wherein the first sidewall of the lifter block is in contact with the frame, and further wherein the first and second sidewalls of the lifter block correspond to the first and second vertical heights of the first and second predetermined positions of the height adjuster, respectively;

wherein the fixed mounting point includes a fastener, and further wherein the fastener separately engages a first fastening point of the height adjuster to secure the height adjuster to the frame in the first predetermined position, and further wherein the fastener engages a second fastening point of the height adjuster to secure the height adjuster to the frame in the second predetermined position; and wherein the at least one height adjuster abuts the support surface along the first surface of the first sidewall and the first surface of the second sidewall when the at least one height adjuster is in the first predetermined position.

10. The appliance of claim 9, wherein the second sidewall of the lifter block is in contact with the frame when the at least one height adjuster is in the first predetermined position.

11. The appliance of claim 9, wherein the at least one height adjuster abuts the support surface along the second surface of the first sidewall and the second surface of the second sidewall when the at least one height adjuster is in the second predetermined position.

12. The appliance of claim 11, wherein the first sidewall of the lifter block is in contact with the frame when the at least one height adjuster is in the second predetermined position.

13. A method of adjusting a height of an appliance relative to a support surface, the method comprising the steps of:

providing the appliance having a housing with one or more fixed mounting points;

providing one or more height adjusters configured to couple to the housing at the one or more fixed mounting points, wherein each of the one or more height adjusters includes first and second sidewalls that are interconnected by a lifter block, wherein the lifter block includes a first length defined along a first sidewall of the lifter block and a second length defined along a second sidewall of the lifter block, wherein the second length is different than the first length, and further wherein one of the first and second side walls includes first and second fastening points;

mounting the one or more height adjusters to the one or more fixed mounting points of the housing in a first configuration using a fastener for each height adjuster, wherein the fastener of each height adjuster is positioned through the first fastening point of the height adjuster and a fixed mounting point of the one or more fixed mounting points of the housing;

positioning the one or more height adjusters on the support surface to provide a first height for the appliance above the support surface;

removing the fastener for each height adjuster;

mounting the one or more height adjusters to the one or more fixed mounting points of the housing in a second configuration using the fastener for each height adjuster, wherein the fastener of each height adjuster is positioned through the second fastening point of the height adjuster and a fixed mounting point of the one or more fixed mounting points of the housing;

positioning the one or more height adjusters on the support surface to provide a second height for the appliance above the support surface; and wherein the first and second sidewalls of the one or more height adjusters each include first and second surfaces, and further wherein the one or more height adjusters abut the support surface along the first surface of the first sidewall and the first surface of the second sidewall when the one or more height adjusters are in the first predetermined position.

14. The appliance of claim 13, wherein the second sidewall of the lifter block is in contact with the housing when the one or more height adjusters are in the first predetermined position.

15. The appliance of claim 13, wherein the one or more height adjusters abut the support surface along the second surface of the first sidewall and the second surface of the second sidewall when the one or more height adjusters are in the second predetermined position.

16. The appliance of claim 15, wherein the first sidewall of the lifter block is in contact with the housing when the one or more height adjusters are in the second predetermined position, and further wherein the second length of the second sidewall of the lifter block is greater than the first length of the first sidewall of the lifter block.

* * * * *